US012643718B2

(12) United States Patent
Bratsch et al.

(10) Patent No.: US 12,643,718 B2
(45) Date of Patent: Jun. 2, 2026

(54) CONTAINER LID HAVING A CLOSABLE VENTILATION OPENING

(71) Applicant: XOLUTION TECHNOLOGY GMBH, Munich (DE)

(72) Inventors: Christian Bratsch, Salzburg (AT); Marc Von Rettberg, Munich (DE)

(73) Assignee: XOLUTION TECHNOLOGY GMBH, Munich (DE)

( * ) Notice: Subject to any disclaimer, the term of this patent is extended or adjusted under 35 U.S.C. 154(b) by 257 days.

(21) Appl. No.: 18/266,520

(22) PCT Filed: Dec. 6, 2021

(86) PCT No.: PCT/EP2021/084416

§ 371 (c)(1),
(2) Date: Oct. 31, 2023

(87) PCT Pub. No.: WO2022/122662

PCT Pub. Date: Jun. 16, 2022

(65) Prior Publication Data

US 2023/0391513 A1 Dec. 7, 2023

(30) Foreign Application Priority Data

Dec. 10, 2020 (EP) ..... 20212936

(51) Int. Cl.
*B65D 51/16* (2006.01)

(52) U.S. Cl.
CPC ..... *B65D 51/1683* (2013.01); *B65D 2205/02* (2013.01)

(58) Field of Classification Search
CPC ..... B65D 51/1683; B65D 2205/02; B65D 2231/022
See application file for complete search history.

(56) References Cited

U.S. PATENT DOCUMENTS 5,363,978 A * 11/1994 Molo ..... A47J 36/027 220/834
6,053,474 A * 4/2000 Stucke, Jr. ..... B65D 51/1683 428/118

(Continued)

FOREIGN PATENT DOCUMENTS

CN 1878702 A 12/2006
DE 29914457 U1 12/1999

(Continued)

*Primary Examiner* — James N Smalley
(74) *Attorney, Agent, or Firm* — WARNER NORCROSS + JUDD LLP

(57) ABSTRACT

The invention relates to a lid for a container, in particular for a can, which comprises: a lid surface with a first opening passing through the lid surface; an internal element arranged on an inner side of the lid surface and having a ventilation opening passing through the internal element and being aligned with the first opening; and an actuation element arranged on an outer side of the lid surface, the actuation element having a joint region which subdivides the actuation element into a first and second portion; wherein the first portion of the actuation element is arranged so as to bear on the lid surface; the second portion of the actuation element is pivotable about the joint region relative to the first portion and the second portion comprises a peg for closing the ventilation opening, wherein the peg comprises a latching element, in particular a latching bead extending preferably around the peg, which is able to be releasably latched in a recess of the internal element. The lid according to the invention is characterized by a locking element for locking the latching element in the recess, wherein the locking element locks the latched latching element in a locking position and in an unlocking position of the locking element, the latching element is able to be unlatched from the recess in order to disengage the peg in the ventilation opening so as to open the ventilation opening.

19 Claims, 5 Drawing Sheets

(56) References Cited

U.S. PATENT DOCUMENTS

Figure 1:
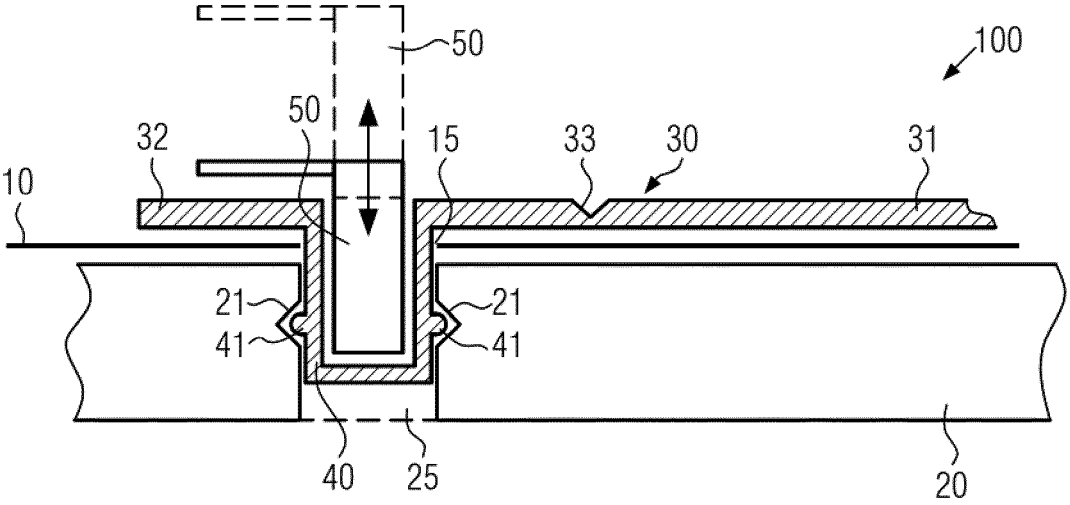

| | | | | |
|---|---|---|---|---|
| 6,554,019 | B1 | 4/2003 | Grittmann | |
| 2007/0068943 | A1* | 3/2007 | Ramsey | B65D 17/506 220/269 |
| 2007/0262079 | A1* | 11/2007 | Paris | B65D 17/506 220/254.4 |
| 2013/0320013 | A1 | 12/2013 | Bratsch | |
| 2014/0332548 | A1* | 11/2014 | Bratsch | B65D 17/506 220/796 |

FOREIGN PATENT DOCUMENTS

| | | | |
|---|---|---|---|
| EP | 2711307 | A1 | 3/2014 |
| EP | 2952438 | A1 | 12/2015 |
| KR | 20110007691 | U | 8/2011 |

* cited by examiner

CONTAINER LID HAVING A CLOSABLE VENTILATION OPENING

CROSS-REFERENCE TO RELATED APPLICATION

This application is a national stage filing based upon International application No. PCT/EP2021/084416, filed 6 Dec. 2021, which claims the benefit of priority to Europe application No. 20212936.7, filed 10 Dec. 2020.

FIELD OF THE INVENTION

The invention relates to a lid for a container, in particular for a beverage can, comprising a lid surface having a first opening passing through the lid surface; an internal element arranged on an inner side of the lid surface, with a ventilation opening passing through the internal element, and the ventilation opening being aligned with the first opening; and an actuation element arranged on an outer side of the lid surface, and wherein a peg is provided for closing the ventilation opening.

PRIOR ART

Lids for containers of the type described above are known from the prior art. The closure element in the form of a peg is usually pressed into the ventilation opening with a certain amount of force and secured by, for example, a seal pressing laterally against the peg. An embodiment of a closure for the ventilation opening with a peg is disclosed, for example, in EP 2711307 A1. Prior art ventilation openings have a sufficiently small cross-section to ensure that they remain securely closed even if, for example, a carbonated beverage is present in the container and internal pressure is thereby present. However, the internal pressure can also be caused by heating of a gas component present in the container and can be up to approximately 8 bar.

However, if the ventilation opening is to have a larger cross-section, for example to allow the insertion of a drinking straw, the force acting on the peg in the closed state may be so great that it is pushed open, since, for example, doubling the diameter of the ventilation opening results in a quadrupling of the force acting on the peg. Conventional measures to hold the peg in the ventilation opening, such as a bead running around the peg, which engages in a recess in the internal element, are then no longer sufficient to prevent unintentional push open by the pressure acting from the inside.

DESCRIPTION OF THE INVENTION

It is the object of the invention to overcome the above disadvantage and to provide a secure multiple closing of the ventilation opening.

This problem is solved by a lid for a container according to claim 1.

The lid for a container, in particular for a can, according to the invention comprises: a lid surface having a first opening passing through the lid surface; an internal element arranged on an inner side of the lid surface with a ventilation opening passing through the internal element and the ventilation opening being aligned with the first opening; and an actuation element arranged on an outer side of the lid surface, the actuation element having a joint region subdividing the actuation element into a first and a second portion; wherein the first portion of the actuation element is arranged so as to bear on the lid surface; the second portion of the actuation element is pivotable about the joint region relative to the first portion and the second portion comprises a peg for closing the ventilation opening, wherein the peg comprises a latching element, in particular a latching bead extending preferably around the peg, which is able to be releasably latched in a recess of the internal element. The lid according to the invention is characterized by a locking element for locking the latching element in the recess, wherein the locking element locks the latched latching element in a locking position and in an unlocking position of the locking element, the latching element is able to be unlatched from the recess in order to disengage the peg in the ventilation opening so as to open the ventilation opening.

The latching element of the peg engages in the recess of the internal element when the ventilation opening is closed. The peg can be designed to be flexible/elastic in order to effect a force-locking and form-fitting engagement/snapping of the latching element. The peg can be pulled out again by an outwardly directed tractive force on the second portion of the actuation element, whereby the coupling of the latching element and the recess requires a minimum force on the peg in order to release this coupling again and thus disengage the latching element. In the locking position, the locking element ensures that the latching element cannot be pushed out of the recess in the internal element due to internal pressure forces on the peg. The peg as well as the latching element arranged thereon are preferably integrally formed in one piece and preferably of plastic material. Likewise, the internal element along with the recess is preferably made of plastic material. In this manner—in addition to the design of the peg—there is a flexibility or elasticity due to the material.

An advantageous optional embodiment is that, prior to the first opening, there is a connection between the locking element and the second portion of the actuation element or the outside of the lid surface, which is destroyed when the locking element is moved from the locking position to the unlocking position for the first time (predetermined breaking point). Alternatively, or additionally, a portion of the locking element may be permanently bent when the locking element is first moved from the locking position to the unlocking position. Each of these embodiments represents a tamper-evident seal, since the destroyed connection or the bending can be used to detect that the locking element has already been opened for the first time.

The lid according to the invention can be further developed in that the peg has an outwardly open cavity and the locking element has a plug, and the plug of the locking element is located inside the cavity of the peg in the locking position. The peg with the cavity is flexible/elastic when made of a plastic material, thereby allowing deformation of the wall of the peg in the direction of the cavity, and there is a flexibility or elasticity of the peg due to the cavity. By pressing the plug into the cavity of the peg, this deformation is prevented so that the latching element arranged on the outside of the peg can no longer move out of the recess, but only again after the plug has been removed/extracted from the cavity. The plug may also be provided with a cavity and be open to at least one side (top and/or bottom). Furthermore, the peg and the plug may have a cylindrical shape.

The plug may have at least one cam and at least one projection may be provided in the cavity of the plug, wherein the at least one cam may be clamped in the locking position with the at least one projection. Preferably, there are two cams on opposite sides of the plug or three spaced cams, with respective projections disposed at complementary, opposite positions of the cavity. In particular, the at least one cam and the at least one projection may be arranged such that clamping does not occur until the end of the plug insertion process.

The plug may be rotatable about an axis for clamping the at least one cam to the at least one projection within the cavity. Thus, clamping of the cam with the projection in the locked position can be accomplished by simply rotating the plug after it has been inserted into the cavity.

The locking element can further comprise a tab on which the plug is arranged, wherein the plug can then be pulled out of the cavity by means of the tab or wherein the plug can be rotated in the cavity by means of the tab. In this manner, the plug can be moved easily and conveniently.

The tab may be connected to the actuation element and/or the lid surface; or the tab may be non-rotatably connected to the plug and may be disposed in the locking position in a first orientation with respect to the second portion of the actuation element, and may be disposed in the unlocking position in a second orientation with respect to the second portion of the actuation element. In the second alternative, the orientation of the tab is further associated with information as to whether the locking element is in the locking position or in the unlocking position. In an advantageous optional embodiment, prior to the first opening, in particular, the tab of the locking element can be connected to the second portion of the actuation element or to the outside of the lid surface via a predetermined breaking point in the sense of the tamper-evident seal mentioned above. For the second alternative, this connection can be permanently visibly destroyed when the tab is turned from the first to the second orientation for the first time.

According to another embodiment, the plug may be pushable into the cavity for moving from the locking position to the unlocking position. For example, the at least one cam of the plug can be moved further into the cavity, resulting in decoupling from the at least one protrusion.

In an alternative embodiment, the locking element can comprise at least one pin, which can be inserted into a respective externally accessible opening between a wall of the peg and the latching element for locking the latching element and can be pulled out of this opening for unlocking.

In another embodiment, the latching element of the peg may be spaced from each end of the peg. Thus, the latching element is provided in a section between the two ends of the peg rather than at one of the ends. This has the advantage, particularly in combination with a hollow peg, of increased flexibility of the peg in the section of the latching element, allowing smooth insertion and removal of the peg into and out of the ventilation opening.

The peg may have a wall with a circular cross-section whose diameter decreases in a step, thereby forming a relatively larger diameter portion and a relatively smaller diameter portion of the peg, and wherein the latching element may be arranged on an outer side of the larger diameter portion, particularly adjacent to the step.

In the case of a peg having a cavity, the step may form a bearing surface in the cavity on which an end surface of the plug at least partially rests in the locked position.

According to another embodiment, in the case of a peg having a cavity, a central outwardly facing pin may be formed in said cavity onto which the plug may be fitted by means of a corresponding central opening formed therein.

A further embodiment is that a second opening may be provided in the lid surface and that a fluid connection between the second opening and a container interior may be established by folding away the internal element from the inside of the lid surface, wherein the first portion of the actuation element is connected to or contactable with the internal element, in particular allowing a sliding movement relative to each other, and the internal element may be folded away by a displacement of the first portion of the actuation element.

This may be further developed in that the lid may further comprise an inner sliding member arranged on the inside of the lid surface, wherein the first portion of the actuation element is connected to the inner sliding member, and a unit of the first portion of the actuation element and the inner sliding member is displaceable along the lid surface, wherein further the inner sliding member is connected or contactable with the internal element, in particular allowing a sliding movement towards each other, and the internal element is foldable away by a displacement of the unit, and wherein a displacement of the first portion is only possible after an unfolding of the second portion, in particular after the peg is thereby removed from the ventilation opening and the first opening.

The invention also provides a container, in particular a can, comprising: a base body; and a lid according to the invention or one of its embodiments listed above.

The aforementioned further embodiments can be used individually or suitably combined with each other as claimed.

Further features and exemplary embodiments as well as advantages of the present invention are explained in more detail below with reference to the drawings. It is understood that the embodiments do not exhaust the scope of the present invention. It is further understood that some or all of the features described below may also be combined in other ways.

DRAWINGS

FIG. 1 shows a first embodiment of a lid according to the invention.

Figure 2A:
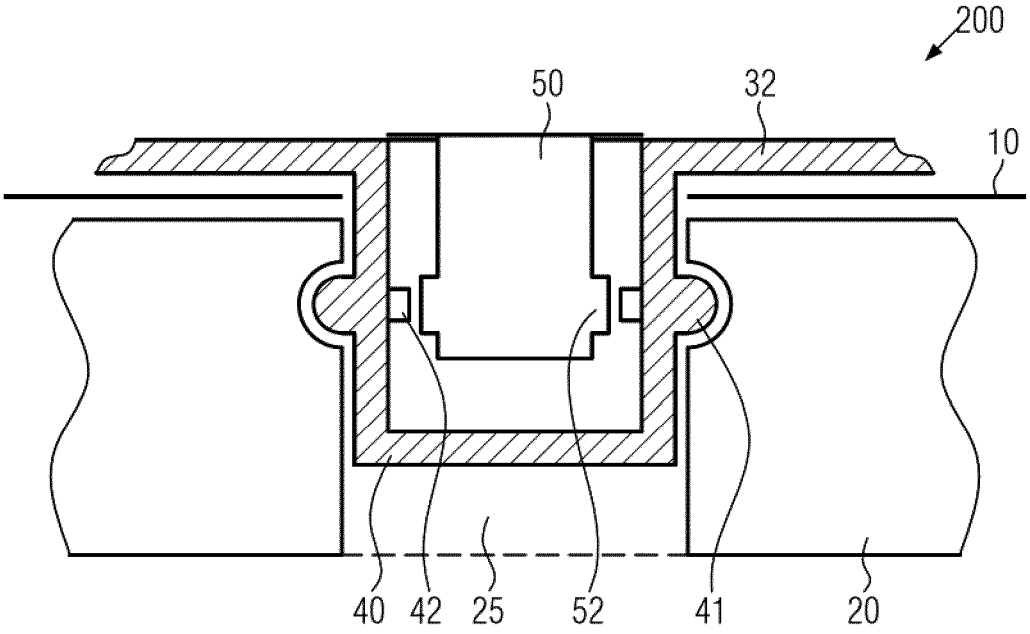

FIG. 2A, B shows a second embodiment of a lid according to the invention.

Figure 3:
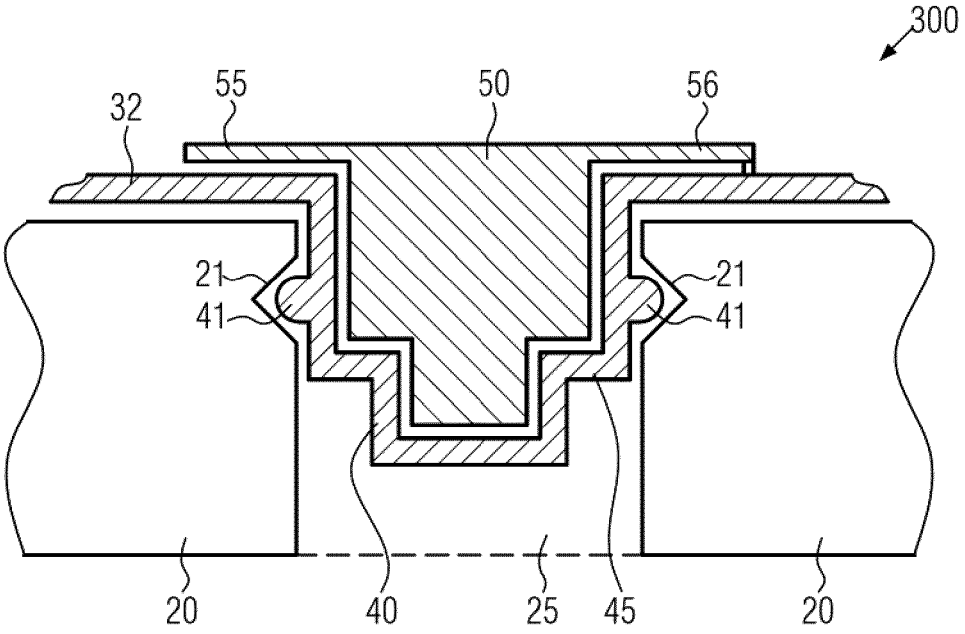

FIG. 3 shows a third embodiment of a lid according to the invention.

Figure 4A:
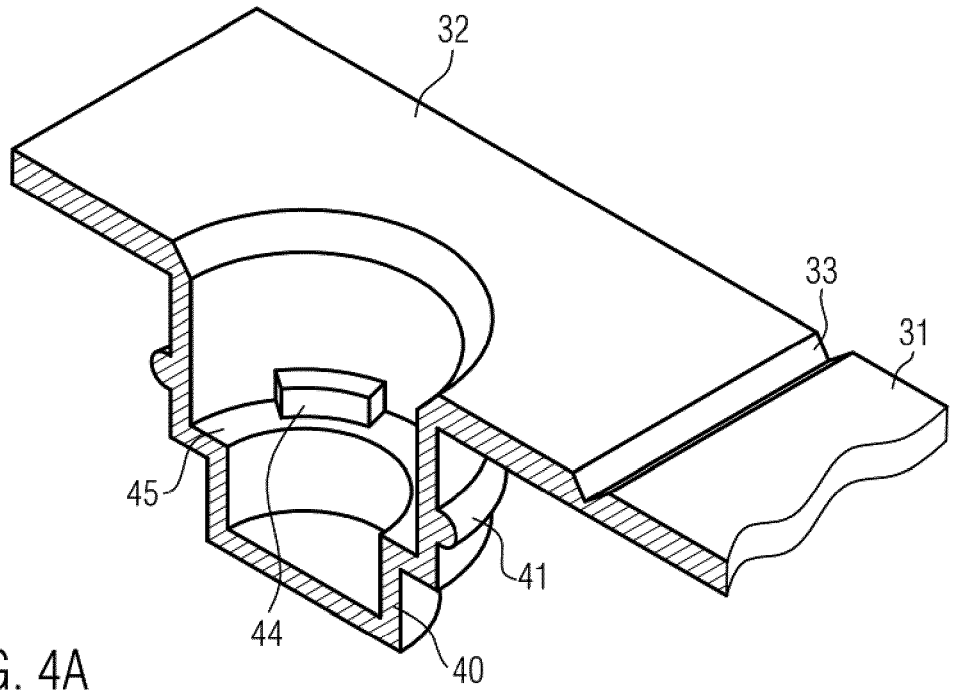

FIG. 4A, B shows details of a fourth embodiment of a lid according to the invention.

Figure 5:
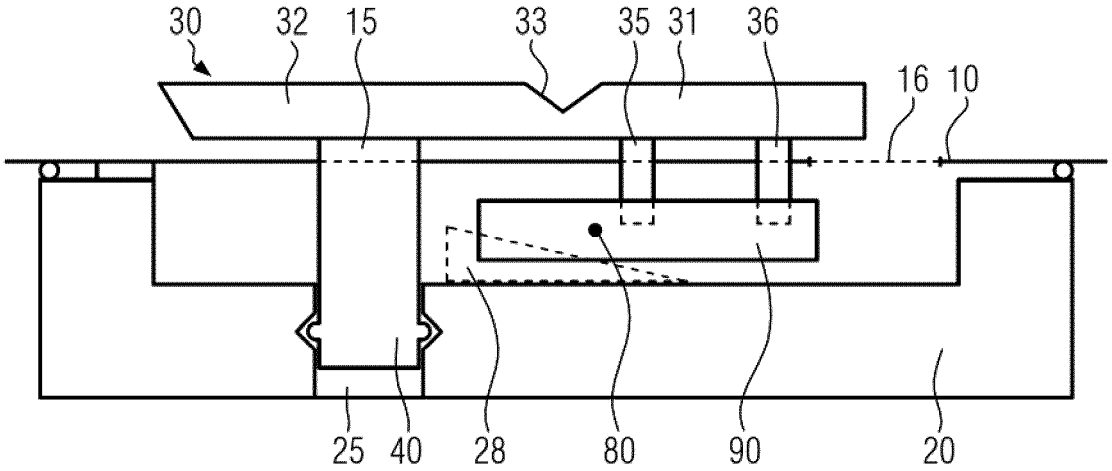

FIG. 5 shows a fifth embodiment of a lid according to the invention.

EMBODIMENTS

In the Figures, identical reference signs denote identical or comparable elements.

FIG. 1 schematically illustrates a first embodiment of a lid 100 according to the invention.

In this first embodiment, the lid 100 according to the invention comprises a lid surface 10 having a first opening 15 penetrating the lid surface; an internal element 20 arranged on an inner side of the lid surface 10 and having a ventilation opening (pressure equalization opening) 25 penetrating the internal element 20 and aligned with the first opening 15; and an actuation element 30 arranged on an outer side of the lid surface and formed, for example, of plastic.

The actuation element 30 has a joint region 33 which divides the actuation element 30 into a first portion 31 and a second portion 32; wherein the first portion 31 of the actuation element 30 is arranged to abut the lid surface 10; the second portion 32 of the actuation element 30 is pivotable relative to the first portion 31 about the joint region 33 and the second portion 32 comprises a peg 40 for closing the ventilation opening 25. The peg 40 comprises a latching bead 41, preferably running around the entire circumference of the peg 40, which can be engaged and disengaged in a recess (notch) 21 of the internal element 20. For this purpose, the design of the peg 40 with the latching bead 41 on the one hand and the internal element 20 with the recess 21 on the other hand is such that elasticity is present and the peg can be pressed into the ventilation opening 25 with a minimum force until the latching bead 41 latches (snaps) into the recess 21. In a corresponding manner, by applying a minimum tractive force on the peg 40, the latching bead 41 can be pulled out of the recess 21 and thus the peg 40 can be pulled out of the ventilation opening 25.

The lid 100 according to the invention further comprises a locking element (plug) 50 for locking the latching bead 41 in the recess 21, wherein in a locking position the locking element 50 locks the latched latching bead and in an unlocking position of the locking element 50 the latching bead 41 is able to be unlatched from the recess 21 in order to disengage the peg 40 in the ventilation opening 25 for opening the ventilation opening 25.

Figure 2B:
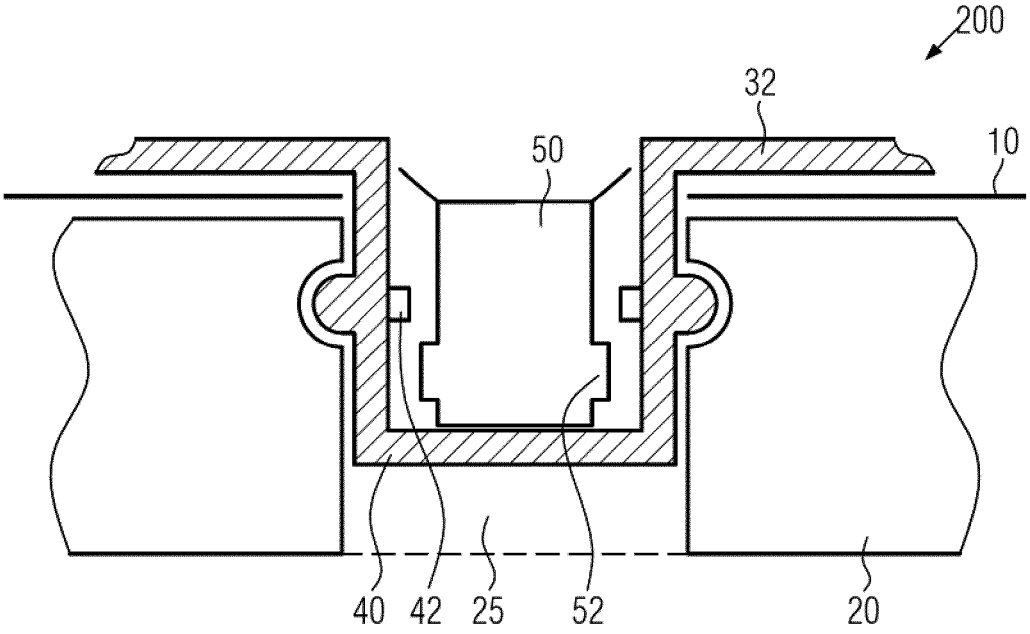

FIGS. 2A and 2B show a schematic illustration of a second embodiment of a lid 200 according to the invention.

In this embodiment, the plug 50 is provided with one or more cams 52. In case of a single cam (bead/crown) 52, for example, it may be formed to run completely or partially around the circumference. In the unopened state of the lid, the plug is connected (e.g. welded) at the upper side to the second portion 32 of the actuation element by relatively thin plastic bridges.

The cam(s) 52 are then located opposite respective projections 42 of the peg 40. Such a locking position is shown in FIG. 2A. To unlock the plug 40 in the ventilation opening 25, the plug is pushed into the cavity, thereby destroying the bridge connection. This unlocking position is shown in FIG. 2B. The cam 52 is now no longer opposite the projection 42, such that with a tractive force being applied upwardly to the peg 40, the latching bead 41 can disengage from the recess 21 of the internal element 20, essentially due to the flexibility of the plastic material of the peg 40 and thus the flexibility of the side walls of the peg 40 toward the cavity. The destruction of the bridge connection between the plug 50 and the second portion 32 of the actuation element during the first opening also serves as a tamper-evident seal, since an opening that has already occurred can be detected based on the destroyed connection.

FIG. 3 illustrates a third embodiment of the lid according to the invention.

In this regard, the peg 40 comprises an indentation 45. The plug 50 has a corresponding indentation of complementary design, so that part of the underside of the plug 50 can rest on the indentation 45. The latching bead 41 is arranged on the outside of the peg 40 in a region above the indentation 45. Thereby, on the one hand, there is a good locking effect when the plug 50 is in the cavity of the peg 40 and, on the other hand, there is a good flexibility of the peg 40 so that it can be easily pulled out of the ventilation opening 25 with the bead 41 slipping out of the indentation 21. By way of example only, the plug 50 is provided here with two tabs 55 and 56. The tab 56 is connected, for example welded, to the top of the actuation element 30, and the plug 50 can be pulled out upwardly by pulling on the tab 55. By reinserting (pushing in) the plug 50 into the cavity of the peg 40, the locking condition can be restored. Thus, after a beverage can has been used for the first time and is incompletely emptied, it can be securely closed again with this lid.

Figure 4B:
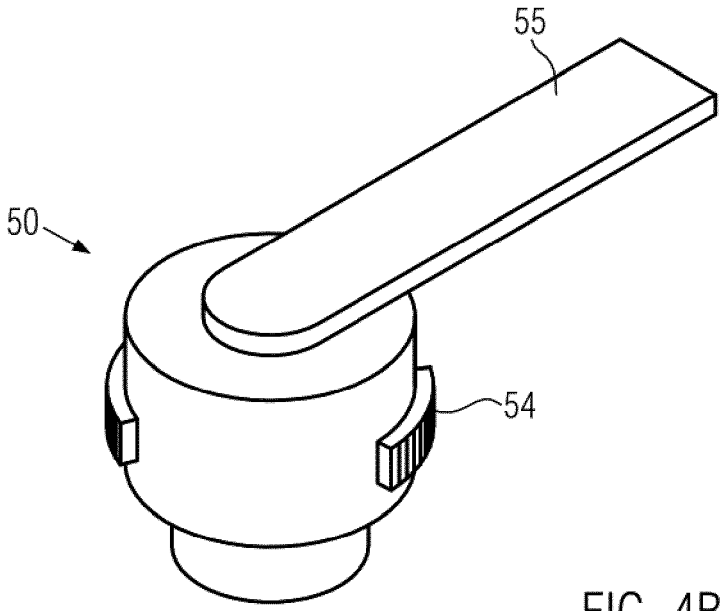

FIGS. 4A and 4B represent a detailed view of a fourth embodiment of the lid according to the invention.

FIG. 4A is a sectional view of the actuator element 30 including the first portion 31, the second portion 32, and the joint region 33 about which the second portion 32 can be folded upward. In this embodiment, the peg 40 also includes an indentation 45 in the cavity. At least one projection 44 is disposed on the indentation 45 in the cavity of the peg 40, preferably two indentations 45 on opposite sides of the step 45 are equally spaced.

FIG. 4B shows an associated plug 50 for locking. It comprises respective cams 54, which can be clamped with corresponding projections 44 by rotation of the plug 50 within the cavity.

For this purpose, the plug 50 comprises a tab 55, which is arranged in a rotationally fixed manner. The projections 44 may be provided with inclined bevels so that the cams 54 can be more easily clamped with the projections 44. The position of the tab on the top of the lid also indicates whether the plug 50 is in the locking or unlocking position.

FIG. 5 schematically illustrates a fifth embodiment of the lid according to the invention. The peg 40 and the locking element 40 (not shown here) can, for example, be designed according to one of the previously described embodiments.

In this fifth embodiment, the actuation element 30 is connected, e.g. by riveting, in the region of the first portion 31 to an inner sliding element 90, which rests against the inside of the lid surface 10. The connecting elements 35, 36 (e.g. rivets) are movable in slot-shaped recesses of the lid surface 10 so that the unit comprising the actuation element 30 and the inner sliding element 90 can be displaced along the lid surface 10 (after the second portion 32 of the actuation element 30 has been folded out). The inner sliding element 90 may further comprise sliding lugs 80, which, when displaced, run onto inclined surfaces 28 of the internal element 20, allowing the internal element 20 to fold away downwardly. Folding the internal element 20 away from the lid surface 10 causes a sealing effect, existing in the closed state, of the internal element 20 against the lid surface 10 to be cancelled and a fluid connection between the interior and exterior being created, thereby exposing a drinking or pouring opening 16.

The invention claimed is:

1. A lid for a container, in particular for a beverage can, comprising:

a lid surface with a first opening passing through the lid surface;

an internal element arranged on an inner side of the lid surface and having a ventilation opening passing through the internal element, the ventilation opening being aligned with the first opening; and an actuation element arranged on an outer side of the lid surface, the actuation element comprising a joint region subdividing the actuation element into a first portion and a second portion, wherein the first portion of the actuation element is arranged so as to bear on the lid surface and the second portion of the actuation element is pivotable about the joint region relative to the first portion and the second portion comprises a peg for closing the ventilation opening, and wherein the peg comprises a latching element which can be releasably latched into a recess of the internal element, wherein the latching element comprises a latching bead which extends around the peg; and a locking element for locking the latching element in the recess, wherein the locking element, in a locking position, locks the latched latching element in the recess and, in an unlocking position of the locking element, the latching element is able to be unlatched from the recess in order to disengage the peg so as to open the ventilation opening;

wherein the peg further comprises a cavity being outwardly opened, and wherein the locking element comprises a plug for insertion in an axial direction into the cavity of the peg, such that in the locking position, the plug of the locking element is located within the cavity of the peg and prevents the latching bead from retracting from the recess of the internal element.

2. The lid according to claim 1, wherein the plug comprises at least one cam and at least one projection is provided in the cavity of the peg, wherein the at least one cam is arranged in the locking position opposite the at least one projection and/or is clamped with the at least one projection.

3. The lid according to claim 2, wherein the plug for clamping the at least one cam with the at least one projection within the cavity is rotatable about an axis.

4. The lid according to claim 1, wherein the locking element further comprises a tab on which the plug is arranged, and wherein the plug is extractable from the cavity by means of the tab and/or wherein the plug is rotatable in the cavity by means of the tab.

5. The lid according to claim 4, wherein the tab is connected to the actuation element and/or the lid surface; or wherein the tab is non-rotatably connected to the plug and, in the locking position, is disposed in a first orientation with respect to the second portion of the actuation element and, in the unlocking position, is disposed in a second orientation with respect to the second portion of the actuation element.

6. The lid according to claim 1, wherein the plug is pushable into the cavity for movement from the locking position to the unlocking position.

7. A lid for a container, in particular for a beverage can, comprising:

a lid surface with a first opening passing through the lid surface;

an internal element arranged on an inner side of the lid surface and having a ventilation opening passing through the internal element, the ventilation opening being aligned with the first opening; and an actuation element arranged on an outer side of the lid surface, the actuation element comprising a joint region subdividing the actuation element into a first portion and a second portion; wherein the first portion of the actuation element is arranged so as to bear on the lid surface; the second portion of the actuation element is pivotable about the joint region relative to the first portion and the second portion comprises a peg for closing the ventilation opening, and wherein the peg comprises a latching element which can be releasably latched into a recess of the internal element, wherein the latching element comprises a latching bead which extends around the peg; and a locking element for locking the latching element in the recess, wherein the locking element, in a locking position, locks the latched latching element in the recess and, in an unlocking position of the locking element, the latching element is able to be unlatched from the recess in order to disengage the peg so as to open the ventilation opening;

wherein the locking element comprises at least one pin which is insertable into a respective externally accessible opening between a wall of the peg and the latching element for locking the latching element and which is removable from this opening for unlocking.

8. The lid according to claim 1, wherein the latching element of the peg is arranged spaced from each end of the peg.

9. The lid according to claim 1, wherein the peg comprises a wall having a circular cross-section, the diameter of which reduces in an indentation, thereby forming a section of the peg with a relatively larger diameter and a section with a relatively smaller diameter, and wherein the latching element is arranged on an outer side of the section with the larger diameter, in particular adjacent to the indentation.

10. The lid according to claim 9, wherein in the locking position, the plug of the locking element is located within the cavity of the peg, and wherein the indentation forms a bearing surface in the cavity on which an underside of the plug at least partially bears in the locked position.

11. A lid for a container, in particular for a beverage can, comprising:

a lid surface with a first opening passing through the lid surface;

an internal element arranged on an inner side of the lid surface and having a ventilation opening passing through the internal element, the ventilation opening being aligned with the first opening; and an actuation element arranged on an outer side of the lid surface, the actuation element comprising a joint region subdividing the actuation element into a first portion and a second portion; wherein the first portion of the actuation element is arranged so as to bear on the lid surface; the second portion of the actuation element is pivotable about the joint region relative to the first portion and the second portion comprises a peg for closing the ventilation opening, and wherein the peg comprises a latching element which can be releasably latched into a recess of the internal element, wherein the latching element comprises a latching bead which extends around the peg; and a locking element for locking the latching element in the recess, wherein the locking element, in a locking position, locks the latched latching element in the recess and, in an unlocking position of the locking element, the latching element is able to be unlatched from the recess in order to disengage the peg so as to open the ventilation opening;

wherein the peg comprises a cavity being outwardly opened and the locking element comprises a plug, wherein in the locking position, the plug of the locking element is located within the cavity of the peg, and wherein a central outwardly facing pin is formed in the cavity onto which the plug can be fitted by means of a corresponding central opening formed therein.

12. The lid according to claim 1, wherein a second opening is provided in the lid surface and a fluid connection between the second opening and a container interior can be established by folding away the internal element from the inside of the lid surface, wherein the first portion of the actuation element is connected to or is contactable with the internal element, in particular allowing a sliding movement relative to one another, and the internal element can be folded away by displacing the first portion of the actuation element.

13. The lid according to claim 12, further comprising an inner sliding member arranged on the inside of the lid surface, wherein the first portion of the actuation element is connected to the inner sliding member and a unit of the first portion of the actuation element and the inner sliding member is slidable along the lid surface, wherein the inner sliding member is further connected or contactable with the internal element, in particular allowing a sliding movement towards each other, and the internal element is foldable away by a displacement of the unit, and wherein a displacement of the first portion is only possible after an unfolding of the second portion, in particular after the pin is thereby removed from the ventilation opening and the first opening.

14. A container, in particular a can, comprising:

a base body; and a lid according to claim 1.

15. The lid according to claim 2, wherein the plug is pushable into the cavity for movement from the locking position to the unlocking position.

16. The lid according to claim 2, wherein the locking element further comprises a tab on which the plug is arranged, and wherein the plug is extractable from the cavity by means of the tab and/or wherein the plug is rotatable in the cavity by means of the tab.

17. The lid according to claim 3, wherein the locking element further comprises a tab on which the plug is arranged, and wherein the plug is extractable from the cavity by means of the tab and/or wherein the plug is rotatable in the cavity by means of the tab.

18. The lid according to claim 1, wherein the peg comprises a wall having a circular cross-section, the diameter of which reduces in an indentation, thereby forming a section of the peg with a relatively larger diameter and a section with a relatively smaller diameter, and wherein the latching element is arranged on an outer side of the section with the larger diameter, in particular adjacent to the indentation.

19. The lid according to claim 2, wherein the peg comprises a wall having a circular cross-section, the diameter of which reduces in an indentation, thereby forming a section of the peg with a relatively larger diameter and a section with a relatively smaller diameter, and wherein the latching element is arranged on an outer side of the section with the larger diameter, in particular adjacent to the indentation.

* * * * *